US009824649B2

(12) United States Patent
Yamauchi et al.

(10) Patent No.: US 9,824,649 B2
(45) Date of Patent: Nov. 21, 2017

(54) GRAY SCALE CONTROL FOR LIQUID CRYSTAL DISPLAYS

(71) Applicants: DENSO International America, Inc., Southfield, MI (US); DENSO CORPORATION, Kariya, Aichi-pref. (JP)

(72) Inventors: Shunji Yamauchi, Farmington Hills, MI (US); Kazuki Kita, Novi, MI (US)

(73) Assignees: DENSO International America, Inc., Southfield, MI (US); DENSO CORPORATION, Kariya, Aichi-pref (JP)

( * ) Notice: Subject to any disclaimer, the term of this patent is extended or adjusted under 35 U.S.C. 154(b) by 70 days.

(21) Appl. No.: 15/086,389

(22) Filed: Mar. 31, 2016

(65) Prior Publication Data

US 2017/0287417 A1 Oct. 5, 2017

(51) Int. Cl.
*G09G 5/02* (2006.01)
*G09G 3/36* (2006.01)

(52) U.S. Cl.
CPC ..... *G09G 3/3607* (2013.01); *G09G 2310/027* (2013.01)

(58) Field of Classification Search
None
See application file for complete search history.

(56) References Cited

U.S. PATENT DOCUMENTS 7,499,014 B2 3/2009 Park
2003/0160804 A1* 8/2003 Willis ..... G09G 3/2014 345/694
2006/0125731 A1* 6/2006 Yui ..... G09G 3/22 345/75.2
2007/0241733 A1* 10/2007 Chen ..... H02M 3/156 323/288
2012/0062526 A1* 3/2012 Wen ..... G09G 3/3648 345/204
2014/0118414 A1* 5/2014 Seo ..... G09G 3/3208 345/690

FOREIGN PATENT DOCUMENTS

KR 20060077095 A 7/2006

* cited by examiner

*Primary Examiner* — Frank Chen
(74) *Attorney, Agent, or Firm* — Harness, Dickey & Pierce, P.L.C.

(57) ABSTRACT

A gray scale control system for a liquid crystal display (LCD) positioned in a vehicle may include a microcontroller unit, a filter, and a switching network. The microcontroller unit may include a PWM port that is configured to supply a PWM signal to a LCD segment of the LCD. The filter may be operable to adjust voltage applied to the LCD segment. The switching network may include a switch device that is connected to the filter. The switching network is operable by the microcontroller unit to electrically couple and decouple the filter between the PWM port and the LCD segment by way of the switch device.

19 Claims, 5 Drawing Sheets

GRAY SCALE CONTROL FOR LIQUID CRYSTAL DISPLAYS

FIELD

The present disclosure relates to LCD gray scale control of liquid crystal displays provided in vehicles.

BACKGROUND

This section provides background information related to the present disclosure which is not necessarily prior art.

Liquid crystal display (LCD) devices are widely used for televisions, laptops, mobile phones, digital watches, and devices of the like. An LCD device generally includes two transparent substrate layers bonded to each other with a predetermined gap between the two substrates and a liquid crystal material that is inserted into the predetermined gap. The first substrate layer includes a plurality of gate lines and data lines that cross each other and form segments (i.e., pixels) on the LCD device and a plurality of electrodes located within each segment. Each gate and data line of a segment may be connected by a thin film transistor (TFT) that controls the application of voltages from the data line to the electrodes located within each segment.

The LCD device has the capability to display a gray scale voltage by incorporating an LCD driver integrated circuit (LCD driver IC) into the system. A gray scale voltage generating circuit within the LCD driver IC may generate a gray scale voltage from a set of supply reference voltages. The gray scale voltage may then drive the data lines of the LCD device. However, the LCD driver IC may have issues due to the difference in the offset voltage of an operational amplifier of the gray scale voltage generating circuit. In addition, the incorporation of the LCD driver IC increases the costs of the LCD device. Thus, there is a need for a low-cost device that generates gray scale voltages for an LCD device.

SUMMARY

This section provides a general summary of the disclosure, and is not a comprehensive disclosure of its full scope or all of its features.

The present disclosure generally relates to a gray scale control system for a liquid crystal display (LCD) positioned in a vehicle. The gray scale control system may include a microcontroller unit, a filter, and a switching network. The microcontroller unit may include a pulse width modulation (PWM) port that is configured to supply a PWM signal to a LCD segment of the LCD. The PWM signal corresponds to a gray scale voltage applied to the LCD segment for displaying the LCD segment in a desired gray shade. The filter may be a RC filter and may be operable to adjust a voltage applied to the LCD segment of the LCD.

The switching network may include a switch device that is connected to the filter. The switching network may be operable by the microcontroller unit to electrically couple and decouple the filter between the PWM port and the LCD segment by way of the switch device. For example, in an aspect of the present disclosure, the switch device may electrically couple the filter to the PWM port for a preset time period before the PWM signal is applied to adjust the voltage at the LCD segment. After the preset time period has lapsed, the switch device may electrically decouple the filter from the PWM port and the LCD segment. Accordingly, the gray scale control system is able to adjust the voltage at the LCD segment by absorbing some of the residual voltage remaining at the LCD segment before the PWM signal is applied to the LCD segment.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 3:
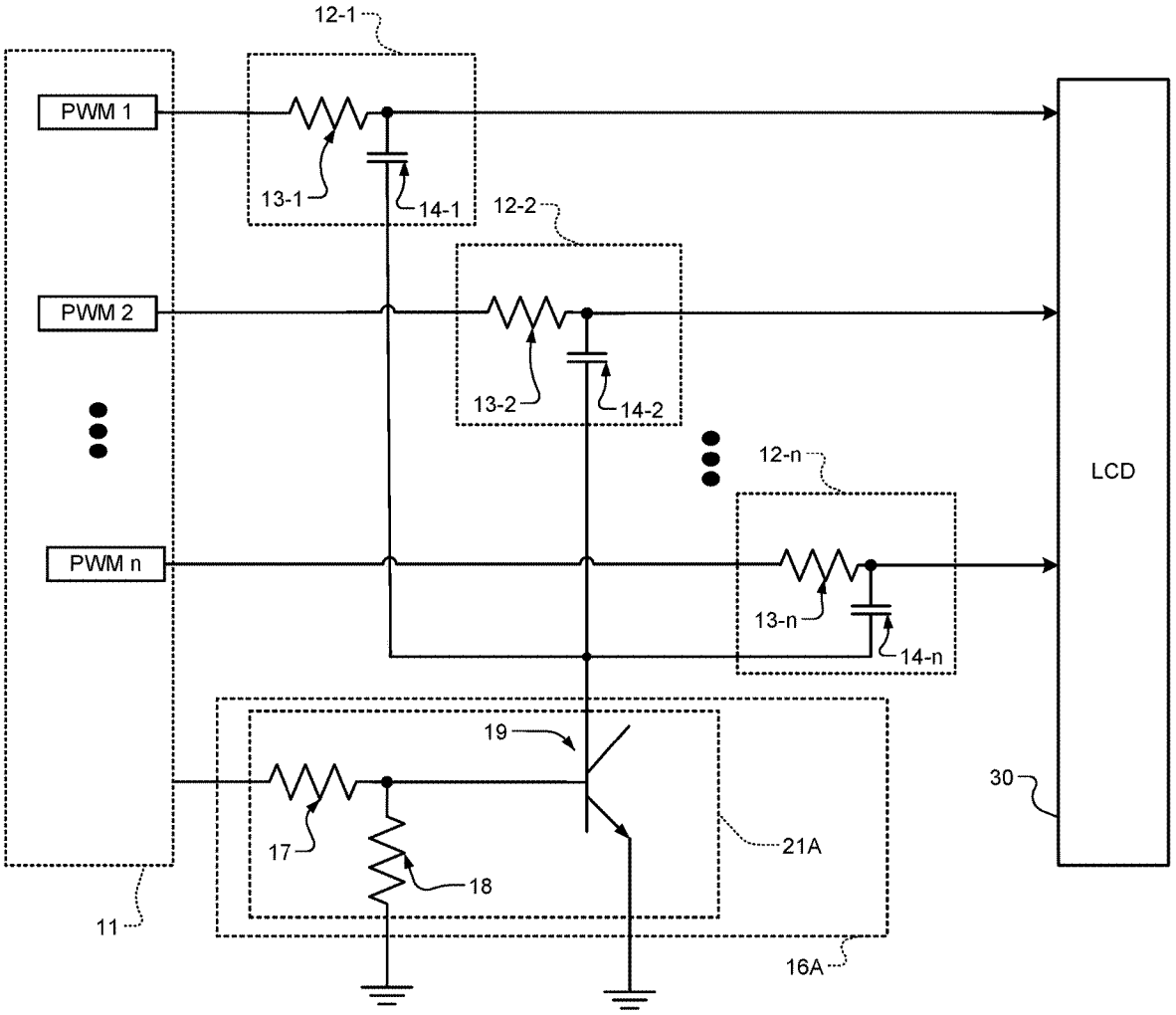
Figure 4A:
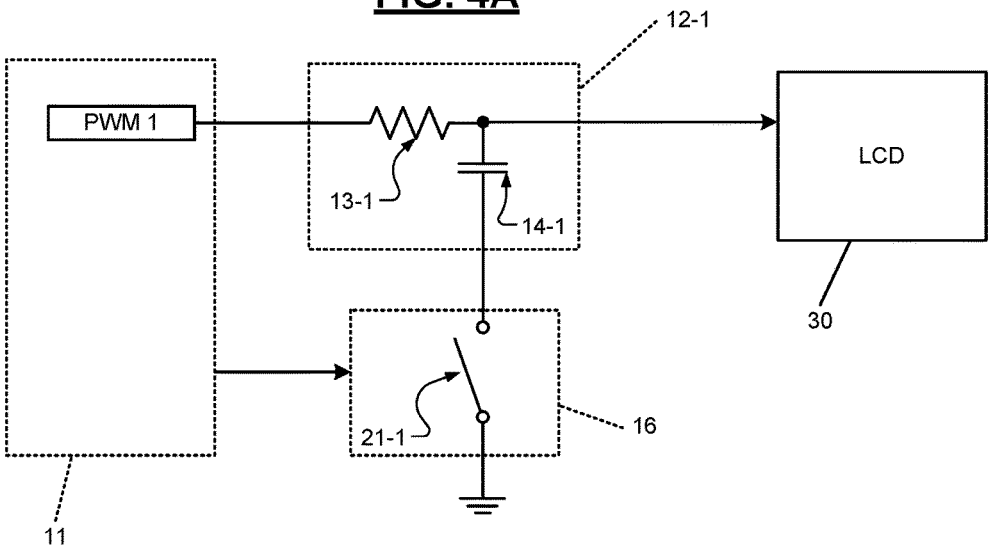
Figure 4B:
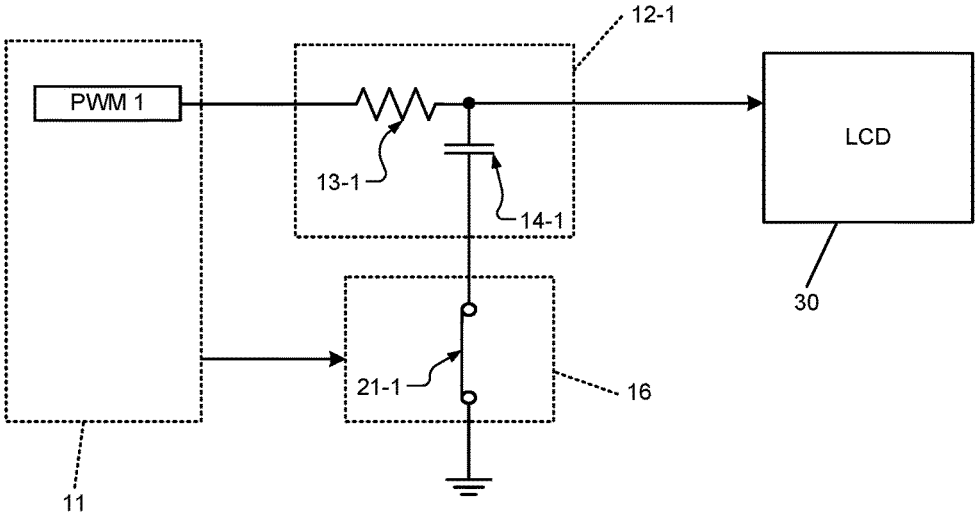
Figure 5:
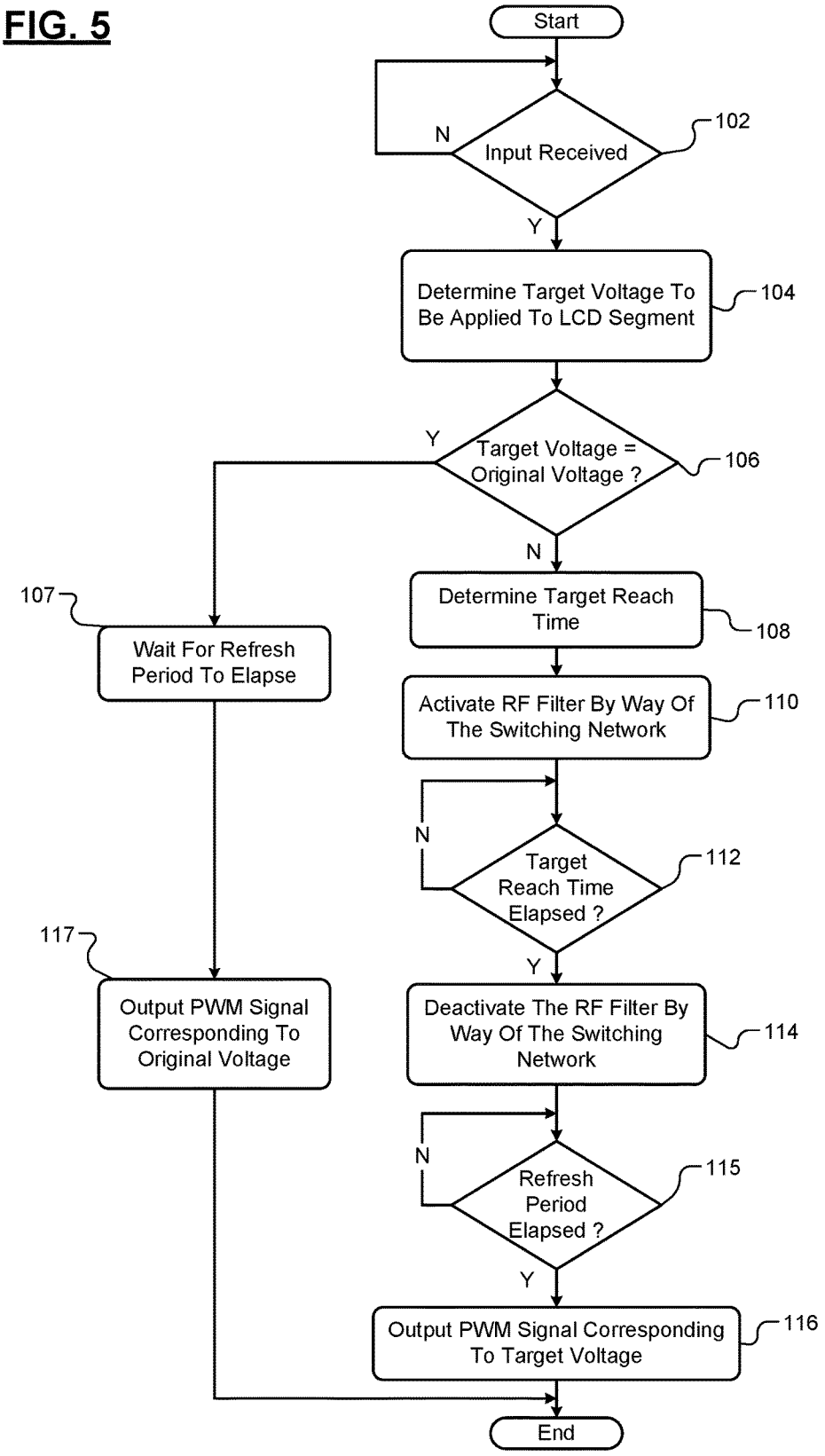

FIG. 3. is a detailed illustration of another example embodiment of the LCD gray scale control device;

FIGS. 4A and 4B are detailed illustrations of the selective coupling and decoupling of the PWM ports to the LCD device; and FIG. 5 is a flowchart of an example routine of the gray scale function for the LCD.

Corresponding reference numerals indicate corresponding parts throughout the several views of the drawings.

DETAILED DESCRIPTION

An LCD gray scale control device of the present disclosure controls the voltage applied to the LCD segments to prevent an uneven gray scale image segment from being displayed that may be caused by residual voltage when adjusting the voltage applied to LCD segments. Specifically, the LCD gray scale control device of the present disclosure includes a microcontroller unit, a plurality of RC filters, a switching network, and an LCD device. The microcontroller unit determines the gray scale voltage to be applied to the LCD segments of the LCD device and outputs a signal corresponding to the gray scale voltage. The plurality of switching networks selectively electrically couple the plurality of RC filters to the LCD segments to control the filtering capability of RC filters.

Example embodiments will now be described more fully with reference to the accompanying drawings.

Figure 1:
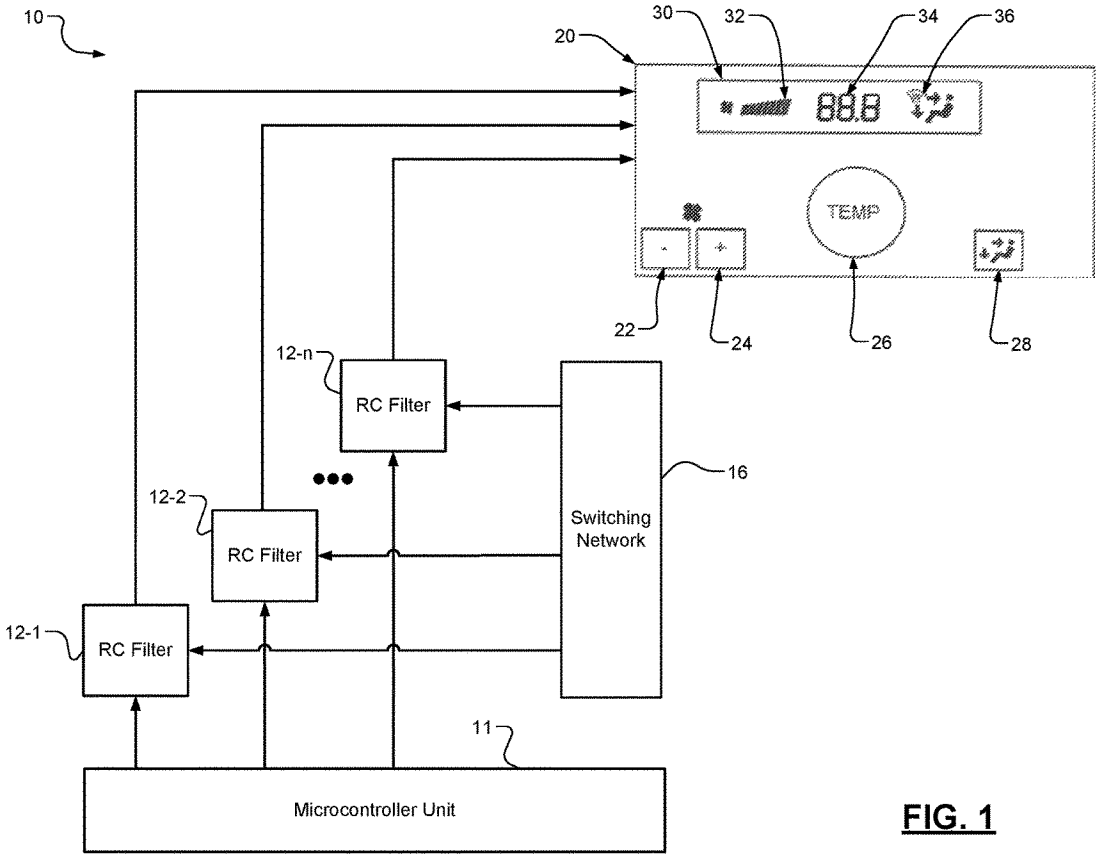
FIG. 1 is a high-level block diagram of a LCD gray scale control implemented in a vehicle.

FIG. 1 is a high-level block diagram of the LCD gray scale control implemented in a vehicle. As an example, a portion of a dashboard 20 of a vehicle 10 includes one or more user interfaces. For example, in the example embodiment, the dashboard 20 includes: pushbuttons 22,24 to adjust a speed of a fan of an air conditioning system; a temperature control knob 26 to adjust a temperature of air flowing into the vehicle 10 from the air conditioning system; a pushbutton 28 that determines through which vents the air will be delivered into the vehicle 10; and an LCD device 30. The pushbuttons 22,24, the temperature control knob 26, and the pushbutton 28 may be collectively referred to as "user input interfaces."

The LCD device 30 includes a plurality of LCD segments 32,34,36 that displays a variety of vehicle parameters. As an example, the LCD segments 32 display the speed of the fan, the LCD segments 34 display the temperature of the air flowing into the vehicle 10 from the air conditioning, and the LCD segments 36 display the vents through which the air is being delivered into the vehicle 10 from the air conditioning system. The visual appearance of the LCD segments may be adjusted based on an operation of one or more user input interfaces. For example, the LCD segments 32 may be associated with pushbuttons 22,24, the LCD segments 34 may be associated with the temperature control knob 26, and the LCD segments 36 may be associated with the pushbutton 28. Accordingly, if the user turns the temperature control knob 26, the LCD segments 34 may be displayed in a different gray color.

The vehicle 10 also includes a microcontroller unit 11 that may receive an input from one or more user input interfaces and that generates a plurality of gray scale voltage values that are displayed at the LCD device 30. A plurality of RC filters 12 (12-1,12-2,**12-*n*) couple the plurality of LCD segments 32,34,36 to the microcontroller unit 11. At least one switching network 16 is implemented to selectively couple and decouple the plurality of RC filters 12 to the microcontroller unit 11. The microcontroller unit 11, the switching network 16, and the RC filters 12 may be referred to as a gray scale control system for the LCD device 30. Furthermore, microcontroller unit 11, the switching network 16, the RC filters 12**, and the LCD device may be referred to as a LCD system for a vehicle.

Figure 2:
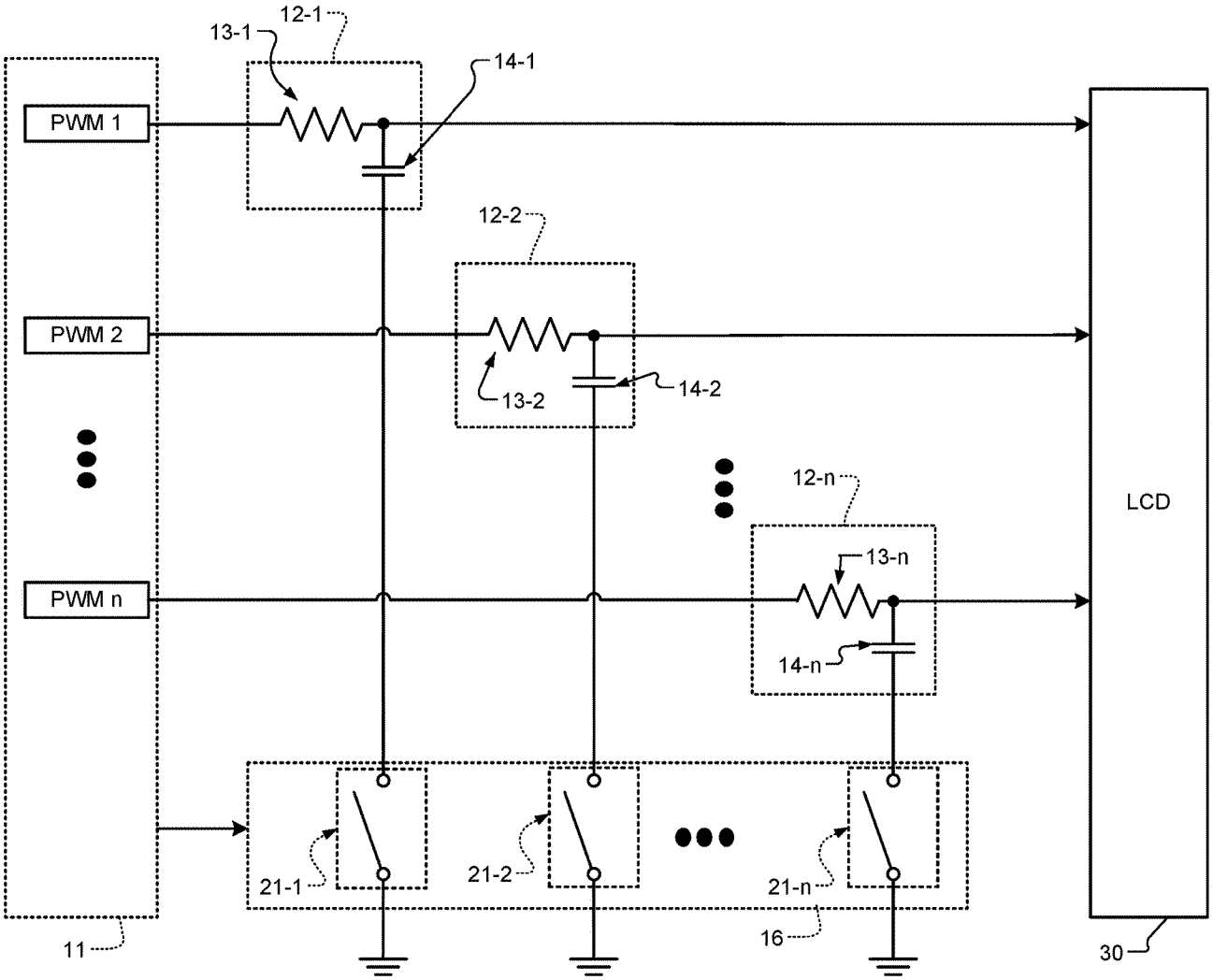
FIG. 2 is a detailed illustration of an example embodiment of the LCD gray scale control device.

FIG. 2 is a detailed illustration of an example embodiment of the LCD gray scale control device. The microcontroller unit 11 includes a plurality of pulse-width modulation (PWM) ports (i.e., PWM 1, PWM 2, . . . , PWM n) that are configured to supply a plurality of PWM signals to the plurality of LCD segments of the LCD device 30. A given PWM signal represents the gray scale voltage that is applied to a respective LCD segment for displaying the LCD segment at a desired gray level. The microcontroller unit 11 may include a processor hardware (shared, dedicated, or group) that executes code and memory hardware (shared, dedicated, or group) that stores code executed by the processor hardware, The number of PWM ports used for generating the PWM signals within the microcontroller unit 11 may be equal to the number of LCD segments within the LCD device 30. As an example, if the LCD device 30 is a 3 digit, 7-segment LCD with decimals, a total of 24 PWM ports within the microcontroller unit 11 may be used for generating the gray scale voltage at each LCD segment of the LCD device 30.

The gray scale voltage is the voltage that corresponds to a shading of gray to be displayed at the LCD segments. As an example, each LCD segment samples 8 bits per period, thus allowing for 256 different shades of gray at each LCD segment. Accordingly, each shade of gray is represented by a unique 8-bit number, and as a result, each 8-bit number corresponds to a single gray scale voltage. For example, the 8-bit number 128 may represent 50% gray shading, and the 8-bit number 192 may represent 75% gray. Accordingly, the 8-bit numbers 128 and 192 may correspond to the gray scale voltage that is 50% and 75%, respectively, of a maximum input voltage of the LCD device 30.

The 8-bit number 0 may represent the color black (i.e., no gray shading), and the 8-bit number 256 may represent the color white (i.e., complete gray shading). Accordingly, the color black may correspond to the gray scale voltage of 0V, while the color white may correspond to the maximum input voltage of the LCD device 30.

The PWM signals generated are a function of the gray scale voltage and the maximum input voltage of the LCD device 30. The maximum input voltage of the device determines an amplitude of the PWM signal. As an example, the microcontroller unit 11 may require a supply voltage of 3.3V. Thus, the maximum voltage input will be 3.3V, and the amplitude of the PWM signal will also be 3.3V (from 0V to 3.3V).

The gray scale voltage also determines a duty cycle of the PWM signal. The duty cycle of the PWM signal may be linearly proportional to the gray scale voltage. As an example, the maximum input voltage may be 5V and the gray scale voltage to be applied to the LCD segment is 3V. Accordingly, the amplitude of the PWM signal will be 5V (from 0V to 5V), and the duty cycle of the PWM signal may be 60%. Thus, the PWM signal will be at 5V for 60% of the period and at 0V for 40% of the period.

The microcontroller unit 11 may be configured to control the gray scale voltage applied to the LCD segments in various suitable ways. For example, the microcontroller unit 11 may adjust a given set of LCD segments if the respective user input interface associated with the LCD segment is operated. Alternatively, the microcontroller unit 11 may adjust all of the LCD segments if any one of the user input interfaces is operated. The microcontroller unit 11 may also adjust the voltage applied to one or more LCD segments after a preset time period has lapsed since a user interface was operated. The microcontroller unit 11 may store predefined algorithms and/or tables that are used to determine the target voltage to be applied to one or more LCD segments.

The plurality of RC filters 12 are positioned between the plurality of LCD segments and the plurality of PWM ports. The plurality of RC filters 12 each include a resistor 13 (13-1,13-2,**13-*n*) and a capacitor 14 (14-1,14-2,14-*n*). The capacitors 14 of each RC filter 12 are coupled to the switching network 16, and the common node of each of the resistor 13 and the capacitor 14 is coupled to the LCD 30**.

The plurality RC filters 12 are implemented to allow for gradual changes between different gray scale voltages that are provided to the LCD segments. As an example, when the gray scale voltage currently provided to the LCD segment is 2V, and the gray scale voltage provided to the LCD segment needs to be changed to 1V as a result of a command from the microcontroller unit 11, the RC filters 12 limit instantaneous voltages changes that are applied to the LCD segments. The limitation of instantaneous voltage changes may preserve the useful life of the LCD device 30 and protect the microcontroller unit 11 from receiving large instantaneous voltages that may damage various internal components of the microcontroller unit 11.

The resistor 13 and the capacitor 14 of the RC filter 12 may be chosen to have a resistance and a capacitance such that a RC time constant of the resistor 13 and the capacitor 14 optimizes fast RC time constants and the limitation of instantaneous voltage changes. The RC time constant is provided as the product of a resistance and a capacitance of the RC filters 12 and is the time required to charge the capacitor 14 through the resistor 13, for example, by approximately 63.2% of the difference between an original voltage and a target voltage.

The RC time constant may be based on a refresh rate of the LCD device 30. The refresh rate is defined as the frequency in which the LCD device 30 updates the applied voltage to each of the LCD segments. As an example, assuming the refresh rate of the LCD device 30 is 800 Hz (i.e., the LCD segments are updating their gray scale voltages every 0.00125 seconds), the RC time constant should be chosen so that it is less than the refresh rate. Thus, the resistor 13 and the capacitor 14 may be chosen to have the RC time constant of 0.0001 seconds, for example (i.e., C=1 nF, R=100 kΩ).

In addition to the above considerations in selecting the resistance and capacitance, RC noise may be taken into consideration when determining the RC time constant. In the above example, the resistor 13 and the capacitor 14 chosen to have the RC time constant of 0.0001 seconds may produce a signal that produces an undesirable amount of noise. Thus, the RC time constant may have to be increased (i.e., closer to the refresh rate) to limit RC noise.

The switching network 16 electrically couples and decouples the RC filter 12 between the PWM port and the LCD device 30. The switching network 16 comprises one end that is coupled to the plurality of RC filters 12 and an opposite end that is coupled to a ground potential. The switching network 16 is also coupled to and is operable by the microcontroller unit 11.

In an example embodiment, the switching network 16 comprises one or more switch devices 21, and the switch device 21 may be a relay, transistor, MOSFET, or other device of the like. The number of switch devices 21 may depend on the number of LCD segments within the LCD device 30 that need to be independently controlled. As an example, to individually control each LCD segment, the number of switch devices 21 within the switching network 16 is equal to the number of LCD segments within the LCD device 30.

The switching network 16 electrically couples and decouples the RC filter 12 between the PWM port and the LCD device 30 based on a command from the microcontroller unit 11. An algorithm for determining when to open and close the switch device 21 may be done by various means. The electrical coupling and decoupling of the RC filters 12 between the plurality of PWM ports and the LCD device 30 is described below with reference to FIGS. 4A and 4B.

FIG. 3. is a detailed illustration of another example embodiment of the LCD gray scale control device. This embodiment is similar to FIG. 2, except that it includes a switching network 16A that has only one switch device 21A. This may be implemented to uniformly apply the gray scale voltage to all of the LCD segments simultaneously, as opposed to individually controlling the gray scale voltage applied to each LCD segment in FIG. 2.

The switch device 21A comprises a bipolar junction transistor (BJT) 19 with a collector terminal connected to each of the plurality of RC filters 12. The BJT 19 may be a NPN transistor. Alternatively, a MOSFET may be used in place of the BJT 19. A first end of a resistor network comprising resistors 17,18 may be electrically coupled to a base terminal of the BJT 19 in order to drive and operate the BJT 19. An opposite end of the resistor network may be coupled to the microcontroller unit 11 so that the BJT 19 can receive a signal from the microcontroller unit 11. Each of the switch devices of FIG. 2 may have the same configuration of the switch device 21A of FIG. 3. The switch device for FIGS. 2 and 3 may be configured in other suitable ways, and is not limited to the examples of the present disclosure.

The microcontroller unit 11 operates the switching network 16 to electrically couple and decouple the plurality of RC filters 12 to the LCD segments of the LCD device 30. In the example embodiment of FIG. 3, the microcontroller unit 11 supplies a drive signal (i.e., a voltage signal) to the base terminal of the BJT 19 of the switch device 21A to electrically couple the capacitors of the plurality of RC filters 12 to the ground potential, thereby activating the plurality of RC filters 12. In particular, by driving the transistor of the switch device 21A, the switching network 16A electrically couples the RC filters 12 to the LCD segments and the PWM ports. The microcontroller unit 11 does not apply the drive signal to the base terminal of the BJT 19 of the switch device 21A to electrically decouple the capacitors of the RC filters 12 from the ground potential, thereby deactivating the RC filters 12. Specifically, by not driving the transistor, the switch device 21A is essentially in an open state and the switching network 16A electrically decouples the RC filters from the LCD segments and the PWM ports.

FIGS. 4A and 4B illustrate a portion of the LCD gray scale control device of FIG. 2 and shows the operation of the switch device 21-1 of the switching network 16 to couple/decouple the RC filter 12-1 between the PWM port (PWM 1) and the LCD device 30. FIG. 4A illustrates the switch device 21-1 in an OFF state (i.e., open) in which the switch device 21-1 electrically decouples the RC filter 12-1 from the LCD device 30 and the PWM 1 by disconnecting the capacitor 14-1 of the RC filter 12-1 from the ground potential. Consequently, the PWM signal that is generated by the microcontroller unit 11 at the PWM 1 is applied to the LCD segment of the LCD device 30 by way of the resistor 13-1 without being adjusted by the capacitor 14-1. Specifically, the RC filter 12-1 is deactivated, and therefore, does not receive PWM signal from the PWM 1 as a result of the capacitor 14-1 being disconnected from the ground potential.

The switch device 21-1 may remain in the OFF state unless the voltage applied to the LCD needs to be changed to a new target voltage. As an example, if the gray scale voltage applied to the LCD segment is 3V, the switch device 21-1 remains in the OFF state until the microcontroller unit 11 determines that a new target voltage, such as 2V, needs to be applied to the LCD segment based on, for example, an external input from at least one of the user input interfaces.

FIG. 4B is an illustration of the switch device 21-1 of the switching network 16 during an ON state (i.e., device 12-1 is closed). When an original voltage applied to the LCD segment needs to be changed to a new target voltage, the microcontroller unit 11 controls the switch device 21-1 from the OFF state to the ON state by, for example, driving a transistor provided in the switch device 21-1. During the ON state, the switch device 21-1 electrically couples the capacitor 14-1 of the RC filter 12-1 to the ground potential. Consequently, the RC filter 12-1 is activated and adjusts the voltage between the PWM 1 and the LCD segment. The RC filter 12-1 gradually changes the voltage at the LCD segment. Specifically, the capacitor 14-1 of the RF filter 12-1 charges to gradually change the voltage applied to the LCD segment.

The switch device 21-1 remains in the ON state until a preset time period has lapsed. As an example, if the gray scale voltage applied to the LCD segments is 3.3V, and the microcontroller unit 11 determines the gray scale voltage needs to be modified to the new target voltage of 1.6V, the switch device 21-2 electrically couples the capacitor 14 to the ground potential before the PWM signal indicative of the new target voltage of 1.6V is applied to the LCD segments. After the preset time period lapses, the switch device 21-1 is opened to electrically decouple the capacitor 14-1 from the ground and therefore, electrically decouples the RC filter 12-1 from the PWM 1 and the LCD device. The PWM signal indicative of the new target voltage of 1.6V is then applied to the LCD segment.

The switch device 21-1 may also begin in the ON state when there is no voltage applied to the LCD segment (i.e., before an initialization of the LCD device 30). In addition, the switching network 16A may also be configured to remain in the ON state if a transition from no voltage applied to the LCD segment to the new target voltage occurs in order to limit the amount instances the switch device 21-1 changes from the OFF state to the ON state, thereby preserving the useful life of the switch device 21-1 and decreasing the load on the microcontroller unit 11.

The operation of the switch device 21-1 of the switching network 16, as described above, is also applicable to the other switch devices 21 of the switching network 16 and is applicable to the switch device 21A of the switching network 16A of FIG. 3. For example, with respect to the switching network 16 of FIG. 2, the microcontroller unit 11 controls each of the RF filters 12 separately by way of the respective switch device 21. Thus, if the voltage of the LCD segment connected to the RC filters 12-2 needs to be adjusted, but the voltage for the other LCD segments do not, the microcontroller unit 11 operates the switch device 21-2 of the switching network 16 to close the device 21-2. Thus, the RC filter 12-2 is electrically coupled between the PWM 2 and respective LCD segment. The other switch devices 21 may remain open since the voltage has not changed for their respective LCD segment. The microcontroller unit 11 may operate more than one switch device 21 at a time based on the number of LCD segments that are to receive a different voltage, and is not limited to operating just one switch device at a time.

The amount of time a given switch device 21 remains in the ON state (i.e., the preset time period) is determined based on a target reach time, which is the amount of time needed to reach the target voltage from the original voltage. The target reach time may be based on the RC time constant of the RC filters 12. The target reach time may be equal to the RC time constant, or it may be greater than the RC time constant. As an example, if the RC time constant is 0.0001 seconds, the target voltage reach time may be 0.0004 seconds (i.e., four times the RC time constant). By having the target reach time be based on the RC time constant, the RC filter 12 essentially charges before the switching network 16 transitions into the OFF state.

FIG. 5 is a flowchart of an example routine of the gray scale control operation for the LCD for the switching network 16A in which one switch device is used to control all of the LCD segments. As an example, the routine begins in this embodiment when the vehicle is turned on and the LCD device receives power and may be performed by the microcontroller. At 102, the routine determines whether a user has operated a user interface, such as pushbuttons, 22,24, temperature control knob 26, and/or pushbutton 28. If one or more of the user interfaces is operated, the microcontroller unit determines the target voltage to be applied to the LCD segments based on the user input at 104. For example, if the user operates the temperature control knob 26, the microcontroller unit may adjust the voltage of the LCD segments 34 which displays the temperature of the air outputted, or alternatively, adjusts the voltage of all of the LCD segments 30, 32, 34, 36.

Based on the target voltage, the microcontroller unit determines whether the target voltage is equal to the original voltage at 106 (i.e., the user input does not change the voltage applied to the LCD segment). If the target voltage and original voltage are equal, the routine waits for the refresh period to elapse at 107. The refresh period is provided as the inverse of the refresh rate, or the amount of time it takes for the LCD device to update the applied voltage to each of the LCD segments. As an example, assuming the refresh rate of the LCD device is 800 Hz, the refresh period of the LCD device is 0.00125 seconds. Once the refresh period has elapsed, the microcontroller unit outputs the PWM signal corresponding to the original voltage at 117. Otherwise, if the target voltage is not equal to the original voltage at 106, the routine proceeds to 108.

At 108, the microcontroller unit determines the target reach time, which is the amount of time needed to reach the target voltage from the original voltage. At 110, the microcontroller unit sets the switching network to the ON state (i.e., closes the switch). During this step, the switching network electrically couples the capacitor of the RC filter to the ground potential, thereby activating the RC filter to absorb voltage provided at the LCD segment. The routine remains at step 110 until the target reach time (i.e., a preset time period) has elapsed, as indicated by step 112. Once the target reach time has elapsed, at step 114, the microcontroller unit sets the switching network to the OFF state (i.e., opens the switch) to electrically decouple the capacitor of the RC filter from the ground potential, thereby deactivating the RC filter. The routine remains at step 115 until the refresh period has elapsed. At step 116, the microcontroller unit outputs the PWM signal that corresponds to the new target voltage once the microcontroller unit has set the switching network to the OFF state, and the routine ends.

A routine for controlling the switching network 16 of FIG. 2 is similar to the routine described in FIG. 5, but the routine may contain additional steps, such as determining which user interface is being operated; determining which LCD segment is associated with the operated user interface; and determining the respective switch device to be operated.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, elements, and/or components, but do not preclude the presence or addition of one or more other features, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

What is claimed is:

1. A gray scale control system for a liquid crystal display LCD positioned in a vehicle, the system comprising:

a microcontroller unit including a pulse width modulation PWM port, wherein the PWM port is configured to supply a PWM signal to a LCD segment of the LCD, and the PWM signal corresponds to a gray scale voltage to be applied to the LCD segment;

a filter including a resistor and a capacitor, wherein the filter is operable to adjust voltage applied to the LCD segment; and a switching network including a switch device, wherein the switch device is connected to the filter, and the switching network is operable by the microcontroller unit to electrically couple and decouple the filter between the PWM port and the LCD segment by way of the switch device.

2. The system of claim 1 further comprising:

a plurality of the filters, wherein:

the microcontroller unit includes a plurality of the PWM ports that supply a plurality of the PWM signals to a plurality of the LCD segments, such that each of the LCD segments receives a single PWM signal, one filter from among the plurality of the filters is provided between one PWM port and a respective LCD segment, and the switching network includes one switch device that is connected to each of the filters, and the microcontroller unit operates the switching network to electrically couple or decouple the filters between the PWM ports and the LCD segments by way of the one switch device.

3. The system of claim 1 further comprising:

a plurality of the filters, wherein:

the microcontroller unit includes a plurality of the PWM ports that supply a plurality of the PWM signals to a plurality of the LCD segments, such that each of LCD segments receives a single PWM signal, one filter from among the plurality of the filters is provided between one of the PWM ports and one of the LCD segments, the switching network includes a plurality of the switch devices, the plurality of the switch devices is connected to the plurality of the filters such that one switch device is provided for each of the filters, and the microcontroller unit selectively operates the switch devices of the switching network to electrically couple or decouple the filters between the PWM ports and the LCD segments.

4. The system of claim 3 wherein each of the switch devices is connected between the capacitor of a respective filter and a ground potential.

5. The system of claim 1 wherein the switch device is connected between the capacitor of the filter and a ground potential.

6. The system of claim 1 wherein:

the microcontroller unit controls the switch device in a first state to electrically couple the filter between the PWM port and the LCD segment before applying the PWM signal to the LCD segment for a preset time period, and the microcontroller unit controls the switch device in a second state different from the first state to electrically decouple the filter between the PWM port and the LCD segment after the preset time period has lapsed.

7. The system of claim 6 wherein the preset time period is greater than or equal to an RC time constant of the filter.

8. The system of claim 1 wherein the switch device electrically couples the filter between the PWM port and the LCD segment during a target reach time, wherein the target reach time is greater than or equal to an RC time constant of the filter.

9. The system of claim 1 wherein an RC time constant of the filter is less than a refresh rate of the LCD.

10. The system of claim 1 wherein:

the resistor connects the PWM port to the LCD segment;

the capacitor is connected in series with the resistor; and the capacitor connects the LCD segment to the switching network.

11. The system of claim 1 wherein the switch device includes a transistor, and the microcontroller unit applies a drive signal to the transistor to electrically couple the filter to the PWM port and the LCD segment.

12. A gray scale control system, the system comprising:

an LCD device including a plurality of LCD segments;

a microcontroller unit that includes a plurality of pulse width modulation PWM ports that supply a plurality of PWM signals to the plurality of the LCD segments, such that each of the LCD segments receives a single PWM signal, and the PWM signal corresponds to a gray scale voltage applied to a respective LCD segment;

a plurality of filters, each of the filters include a resistor and a capacitor, wherein each of the filters is positioned between one PWM port from among the plurality of PWM ports and one LCD segment from among the plurality of LCD segments, and the filters are operable to adjust a voltage applied to the LCD segment; and a switching network including at least one switch device, wherein the at least one switch device is connected to the filter, and the microcontroller unit controls the switching network to electrically couple and decouple one or more filters between one or more PWM ports and one or more LCD segments by way of the at least one switch device.

13. The system of claim 12 wherein the switching network includes one switch device, and the one switch device is connected between the capacitors of the filters and a ground potential.

14. The system of claim 13 wherein:

the microcontroller unit operates the one switch device in a first state to electrically couple the capacitors of the filters to the ground potential for a preset time period before the PWM signals are provided to the LCD segments from the PWM ports, and the microcontroller unit operates the one switch device in a second state to electrically decouple the capacitors of the filters from the ground potential after the preset time period has lapsed.

15. The system of claim 12 wherein the switching network includes a plurality of the switch devices, and each of the switch devices is connected to one filter from among the plurality of filters, and a respective switch device is connected between the capacitor of a respective filter and a ground potential.

16. The system of claim 15 wherein:

the microcontroller unit operates a respective switch device from among the plurality of the switch devices in a first state to electrically couple the capacitor of a respective filter to the ground potential for a preset time period before the PWM signal is provided to a respective LCD segment from a respective PWM port, and the microcontroller unit operates the respective switch device in a second state to electrically decouple the capacitor from the ground potential after the preset time period has lapsed.

17. The system of claim 12 wherein the microcontroller unit operates the at least one switch device to electrically couple one or more of the filters to respective one or more PWM ports and respective one or more LCD segments during a target reach time, wherein the target reach time is greater than or equal to an RC time constant of the filters and less than a refresh rate of the LCD.

18. The system of claim 12 wherein:

the resistor of a respective filter connects a respective PWM port to a respective LCD segment, and one end of the capacitor of the respective filter is connected in series with the resistor; and the other end of the capacitor is connected to the switching network.

19. A method for generating gray scales in a LCD device that is positioned in a vehicle, the method comprising:

determining a target voltage to be applied to an LCD segment of the LCD device;

determining a target reach time based on the target voltage;

setting a switching network to a first state to electrically couple the LCD segment to a filter for a preset time period, wherein the preset time period is based on the target reach time;

setting the switching network to a second state to electrically decouple the LCD segment from the filter after the preset time period has lapsed; and outputting a pulse width modulation signal that is indicative of the target voltage to the LCD segment when a refresh period of the LCD device has lapsed, wherein the preset time period is less than or equal to the refresh period.

* * * * *